US009958229B1

(12) United States Patent
Meier

(10) Patent No.: US 9,958,229 B1
(45) Date of Patent: May 1, 2018

(54) DUST COVER FOR A FIREARM

(71) Applicant: Michael Meier, Thornton, CO (US)

(72) Inventor: Michael Meier, Thornton, CO (US)

(73) Assignee: Helvetic Design Corporation, Thornton, CO (US)

( * ) Notice: Subject to any disclaimer, the term of this patent is extended or adjusted under 35 U.S.C. 154(b) by 64 days.

(21) Appl. No.: 15/084,021

(22) Filed: Mar. 29, 2016

(51) Int. Cl.

| | |
|---|---|
| ***F41A 35/02*** | (2006.01) |
| ***F41A 3/66*** | (2006.01) |
| ***F41A 3/72*** | (2006.01) |
| ***F41A 21/00*** | (2006.01) |
| ***F41A 19/06*** | (2006.01) |

(52) U.S. Cl.
CPC ..... *F41A 35/02* (2013.01); *F41A 3/66* (2013.01); *F41A 3/72* (2013.01); *F41A 19/06* (2013.01); *F41A 21/00* (2013.01)

(58) Field of Classification Search
USPC ..... 42/99, 16, 96; 89/199, 30
See application file for complete search history.

(56) References Cited

U.S. PATENT DOCUMENTS 1,878,038 A * 9/1932 Von Frommer ..... F41A 35/02 42/16
2,288,202 A * 6/1942 Mossberg ..... F41A 35/02 42/16
2,341,767 A * 2/1944 Gans ..... F41A 35/02 42/25
2,916,844 A * 12/1959 Hellstrom ..... F41A 35/02 42/98
2,940,201 A * 6/1960 Reed ..... F41A 35/02 42/16
3,952,440 A * 4/1976 Tellie ..... F41A 35/02 42/106
4,037,344 A * 7/1977 Reed ..... F41A 9/58 42/16
4,044,487 A * 8/1977 Hutton ..... F41A 35/02 42/16
5,918,401 A * 7/1999 Rowlands ..... F41A 35/02 42/14
6,523,293 B2 * 2/2003 Murello ..... F41A 3/26 42/25
7,181,881 B2 * 2/2007 Fischbach ..... F41A 15/00 42/71.01

(Continued)

*Primary Examiner* — Reginald S Tillman, Jr.
(74) *Attorney, Agent, or Firm* — Smith Moore Leatherwood LLP; Thomas W. Epting

(57) ABSTRACT

A cover, or dust cover, for use in a firearm, the firearm being operable for firing a cartridge having a projectile and having a receiver portion including an elongated passageway, a magnetic reciprocatable firing mechanism operable to fire the cartridge, a charging handle connected to the firing mechanism, and a barrel adapted to receive the projectile after the cartridge is fired. The dust cover is adapted for movement and to substantially cover a portion of the passageway. A magnet is connected to the dust cover and is magnetically attracted to the firing mechanism such that the dust cover is drawn towards and substantially follows the firing mechanism as the firing mechanism reciprocates with respect to the receiver upon firing the cartridge, wherein the dust cover intermittently uncovers and covers the portion of the passageway as the firing mechanism reciprocates.

30 Claims, 5 Drawing Sheets

(56) References Cited

U.S. PATENT DOCUMENTS

| | | | | |
|---|---|---|---|---|
| 7,819,052 | B2 * | 10/2010 | Zedrosser | F41A 35/06 89/1.4 |
| 8,800,192 | B2 * | 8/2014 | Brown | F41A 3/66 42/16 |
| 9,341,423 | B2 * | 5/2016 | McGinty | F41A 15/14 |
| 9,341,429 | B1 * | 5/2016 | Reavis, III | F41A 35/02 |

* cited by examiner

DUST COVER FOR A FIREARM

RELATED APPLICATION DATA

This application claims priority under U.S. Non-provisional patent application Ser. No. 14/815,291, filed Jul. 31, 2015, which claimed priority under 35 U.S.C. § 119(e) from U.S. Provisional Patent Application Ser. No. 62/032,122, filed Aug. 1, 2014, U.S. Provisional Patent Application Ser. No. 62/066,045 filed Oct. 20, 2014, and U.S. Provisional Patent Application Ser. No. 62/104,511 filed Jan. 16, 2015, and the entirety of the foregoing applications are hereby incorporated by reference.

FIELD

The present disclosure relates to a dust cover for a firearm, and more specifically, to a dust cover that is magnetically attracted to a firing mechanism of a firearm and which opens and closes automatically as the firearm is discharged.

BACKGROUND

Dust covers for firearms are designed reduce the likelihood of dust, dirt, debris, etc. from entering the firing mechanism of the firearm. Movable dust covers have been used, and in particular, dust covers for rifles such as the AR-15 rifle typically automatically open upon discharge of the rifle, but then must be manually closed at the conclusion of firing one or many rounds of ammunition. Dust covers for firearms such as the AR-15 often include a spring-loaded, hinged door or flap arrangements, which are latched closed when the firearm is not in use, but spring open when released by the movement of the firearm's bolt or bolt carrier. The operator of the firearm must typically then manually close the dust cover at the end of each session or series of shots. In these applications, the dust cover does not travel with the moving parts of the firearm, but simply opens and remains open until manually closed.

Certain firearms, such as an AK-47 rifle, include a side-mounted charging handle, and a track or slot in which the charging handle reciprocates. This slot has the potential to allow dust, dirt, or debris to enter the action of the firearm during operation, transport and/or storage. Some designs, such as the AR-15 rifle, place the charging handle at the rear of the action, but this may result in other issues, such as the charging handle interfering with optics or sighting systems and/or being less ergonomically efficient design than a side-mounted charging handle. For instance, a rear-mounted charging system may be more difficult to operate when a rifle is mounted to an operator's shoulder in a "ready to fire" position, while a side mounted charging handle would typically be more accessible.

Therefore, there exists a need for dust cover for addressing the issues noted above.

SUMMARY

In one aspect, embodiments are described herein which may provide one or more advantages over prior firearm systems, namely, firearms for firing a cartridge having a projectile.

In one implementation, a dust cover is described herein for a firearm that reciprocates with the charging handle to allow the charging handle to move with a bolt carrier when the firearm cycles after being fired. Implementations of the dust cover described herein include the ability to travel with the charging handle, which allows the charging handle to be side-mounted on the firearm, while still obstructing the entrance of dirt and debris through the slot or passageway required for accommodating the reciprocating motion of a side-mounted charging handle, including during firing of the firearm, and without a requirement to manually close the dust cover after firing the firearm.

Implementations described herein include a cover, which may comprise a body member, and which serves to intermittently obstruct exterior openings in equipment such as a firearm. An implementation includes a cover that travels with moving parts in the equipment to allow one or more other moving parts to cycle through such external openings and/or permit the expulsion of used or spent materials, such as a fired cartridge.

An implementation described herein includes a movable a cover comprising a body member operated by being physically pushed in one direction by contact with one or more other moving parts, such as a firing mechanism, bolt carrier, charging handle, etc., and returning to its original position by virtue of being mated to the moving parts with magnets or magnetic force.

In one implementation, a cover comprising a body member, moves within a channel, passageway, or slot, which could be T-shaped track, in a receiver cover and is thus guided into position in both directions. Once inserted into the guide track, a first, side-mounted magnet holds the dust cover in position against gravity or other forces in the forward position. A second, forward-facing magnet is attracted to the magnetic material of the bolt carrier. When the charging handle moves to the rear of the action, in order to cycle and eject a spent, or fired, cartridge, the charging handle and/or the bolt carrier may physically push the dust cover to the rear. As the charging handle moves forward again, the second magnet pulls the dust cover forward, following the charging handle, until the dust cover is again in the forward position, obstructing or covering at least a portion of the passageway or opening in which the charging handle moves.

In one implementation, a cover comprising a body member is described for use in a firearm, the firearm being operable for firing a cartridge having a projectile and having a receiver portion including an elongated passageway having a first, coverable, or, at least one magnet being adapted to be magnetically attracted to the magnetic portion of the firing mechanism such that the cover is drawn towards and substantially follows the firing mechanism during rearward movement of the firing mechanism. gap, portion, a movable or reciprocatable firing mechanism having a magnetic portion, such as a bolt carrier and bolt combination, operable to fire the cartridge, a charging handle connected to the firing mechanism and adapted to move in the passageway, and a barrel adapted to receive the projectile after the cartridge is fired. The firing mechanism is adapted for rearward movement with respect to the receiver portion upon firing of the cartridge and subsequent forward movement. The body member is adapted for movement and to selectively substantially cover a portion of the passageway. At least one magnet is connected to the body member and is magnetically attracted to the firing mechanism such that the body member is drawn towards and substantially follows the firing mechanism as the firing mechanism moves rearwardly with respect to the receiver upon firing the cartridge, and wherein the body member intermittently uncovers and uncovers the gap portion of the passageway as the firing mechanism reciprocates.

In certain implementations, the firing mechanism is elongated and has a forward end and a rearward end and is movable between a forward position substantially adjacent the barrel and a rearward position, and wherein the passageway has forward end and a rearward end, and first portion of the passageway is approximately the distance between the rearward end of the passageway and the rearward end of firing mechanism upon the firing mechanism being in the forward position.

In other implementations, the firing mechanism includes a bolt carrier, and the body member is adapted to intermittently uncover the passageway as the firing mechanism reciprocates. A receiver cover is connected to the receiver portion and defines at least one interior track, and the body member is adapted to move to and fro within the at least one interior track as the firing mechanism reciprocates with respect to the receiver upon firing the cartridge.

In some implementations, at least one magnet is adapted to be magnetically attracted to the magnetic portion of the firing mechanism such that the cover is drawn towards and substantially follows the firing mechanism during rearward movement of the firing mechanism.

In implementations of the present disclosure, the cover is adapted to automatically substantially cover the first portion of the passageway prior to and after the cartridge is fired.

In one implementation, the body member is elongated and includes a forward portion and a rearward portion, and the forward portion includes a first side and a second side generally opposite the first side. The rearward portion includes a first side and a second side generally opposite the first side, and the first side of the forward portion is adjacent the first side of the rearward portion, and the second side of the forward portion is adjacent the second side of the rearward portion. The forward portion and rearward portion each includes a top edge and a bottom edge generally opposite the top edge, and the top edge of the forward portion is adjacent the top edge of the rearward portion. The forward portion also includes a forward extreme end, and the rearward portion has an extreme rear end substantially opposite the forward extreme end. Additionally, the rearward portion defines a leading face substantially opposite the extreme rear end. In one example implementation, the forward end is integral with the rearward portion.

In some implementations, the forward portion and rearward portion are rectangular and integral with one another. The rearward portion includes a longitudinally extending groove adapted to slidingly engage the interior track of the receiver portion. The rearward portion may also include a rail extending along the bottom edge that slidingly engages the interior track, and the rearward portion is carried in the interior track as the cover moves to and fro.

In other implementations, the first side of the forward portion of the body member and the first side of the rearward portion are substantially co-planar, and the top side of the forward portion and the top side the rearward portion are substantially co-planar, and the bottom side of the forward portion is separated from the bottom side of the rearward portion.

In certain implementations, the at least one magnet is connected to the rearward portion and includes a first magnet and a second magnet. In other implementations, the at least one magnet is connected to the leading face of the rearward portion and/or the second side of the rearward portion, and in yet another implementation, the at least one magnet includes a first magnet connected to the leading face of the rearward portion and a second magnet connected to the second side of the rearward portion.

In still other implementations, the body member is non-metallic, and the firing mechanism includes a magnetic bolt mechanism, at least a portion of which is constructed of a ferromagnetic material. In some implementations, without limitation, body member may be made of a suitable plastic, polymeric, metallic materials and/or combinations thereof, such as without limitation titanium, aluminum, alloys. In other implementations, some or all of body member may be made of non-metallic materials such as without limitation such as graphite composites, carbon fiber, engineering plastics, unfilled or glass reinforced polymers and/or laminates.

In a further implementation, an apparatus is described herein for use in a firearm, the firearm being operable for firing a cartridge having a projectile and having a receiver portion including an elongated passageway defining a first passage, a movable or reciprocatable firing mechanism having a magnetic portion and being operable to fire the cartridge, a charging handle connected to the firing mechanism and adapted to move in the passageway, and a barrel adapted to receive the projectile after the cartridge is fired. The receiver portion comprises a receiver cover that includes at least one interior track. A cover comprising a body member is adapted for movement and to selectively substantially cover the first portion of the passageway. At least one magnet is connected to the body member and is adapted to be magnetically attracted to the magnetic portion of the firing mechanism, such that the body member is drawn towards and substantially follows the firing mechanism as the firing mechanism reciprocates with respect to the receiver upon firing the cartridge, and wherein the body member is adapted to move to and fro within the at least one interior track as the firing mechanism reciprocates with respect to the receiver upon firing the cartridge and to selectively uncover the passageway.

In a further implementation, an apparatus is described herein for use in a firearm, the firearm being operable for firing a cartridge having a projectile and having a receiver portion including an elongated passageway, a magnetic reciprocatable firing mechanism operable to fire the cartridge, a charging handle connected to the firing mechanism and adapted to move in the passageway, and a barrel adapted to receive the projectile after the cartridge is fired. The apparatus comprises a cover comprising a body member adapted for movement and to selectively substantially cover the passageway, and at least one magnet is connected to the body member and is adapted to be magnetically attracted to the firing mechanism, such that the body member is drawn towards and substantially follows the firing mechanism as the firing mechanism reciprocates with respect to the receiver upon firing the cartridge, and wherein the body member is adapted to intermittently cover and uncover the passageway as the firing mechanism reciprocates.

The features, functions and advantages discussed herein may be achieved independently in various example implementations or may be combined in yet other example implementations, further details of which may be seen with reference to the following description and drawings.

BRIEF DESCRIPTION OF THE FIGURES

Figure 1:
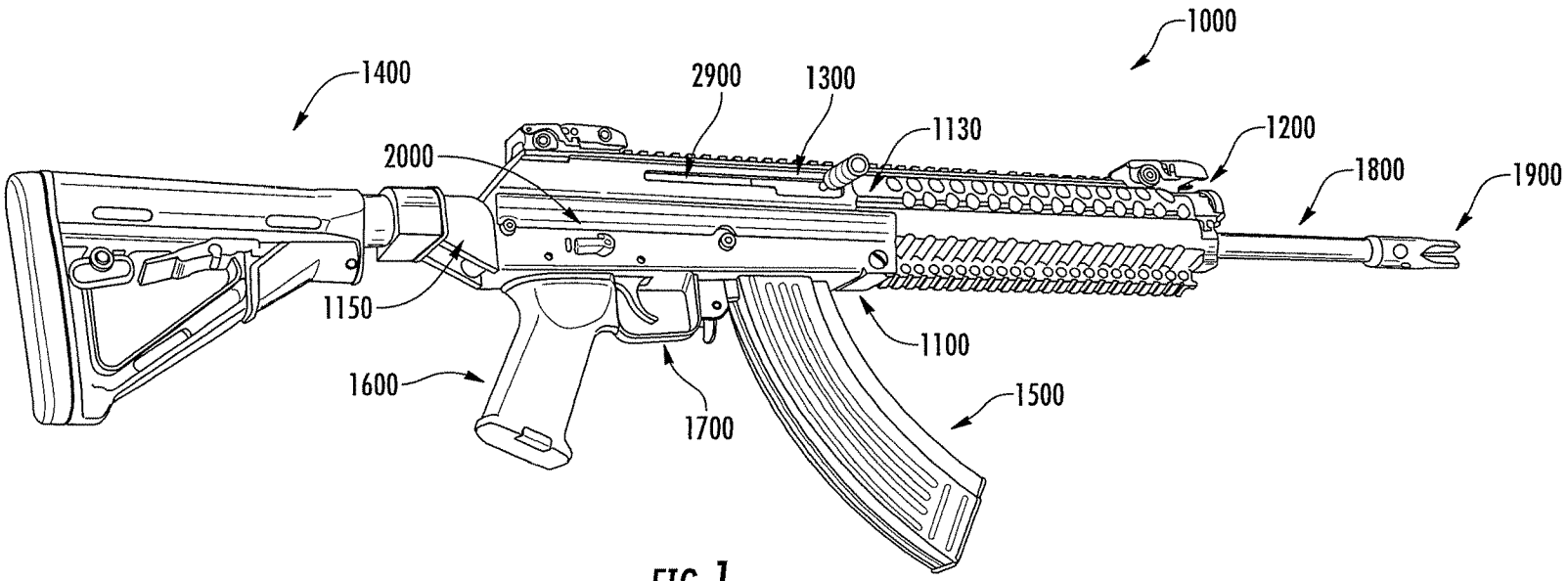
Figure 2A:
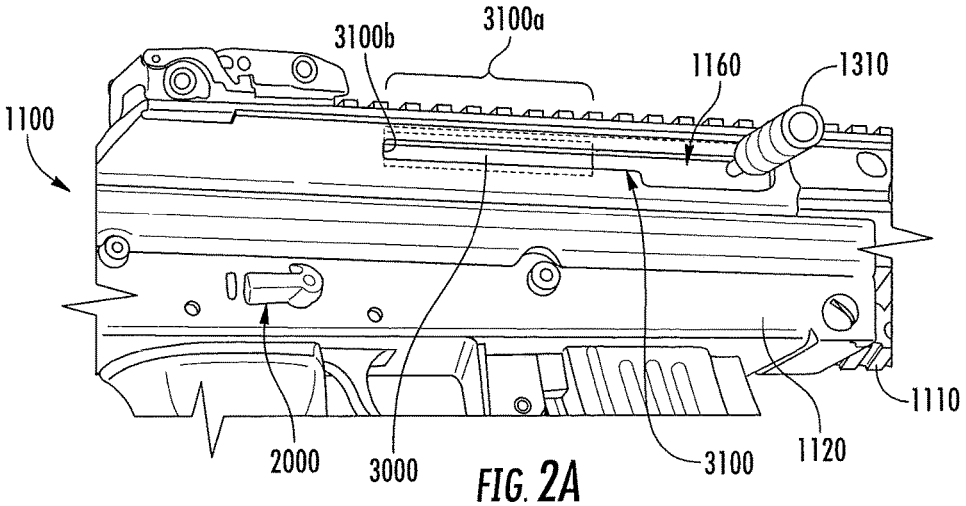
Figure 2B:
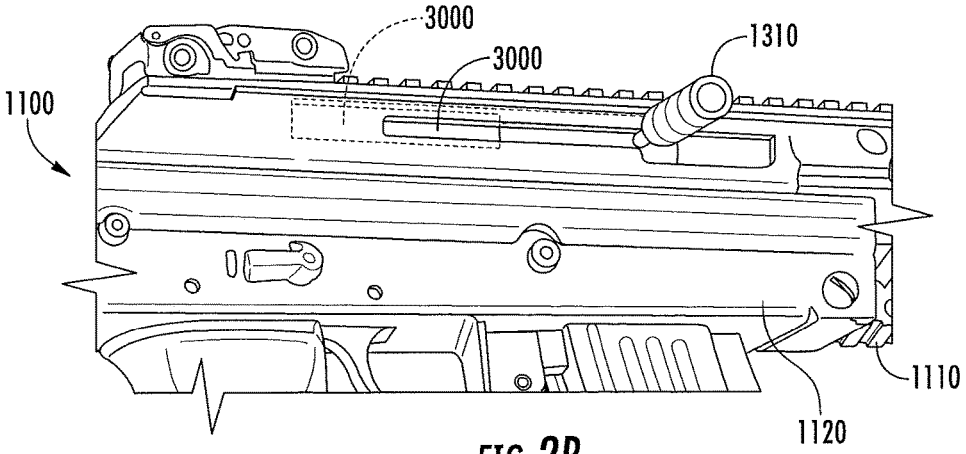
Figure 2C:
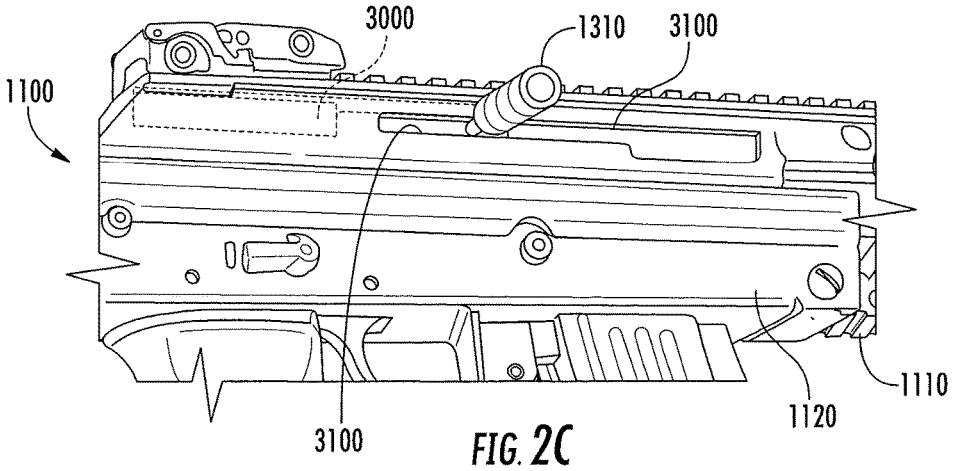
Figure 3:
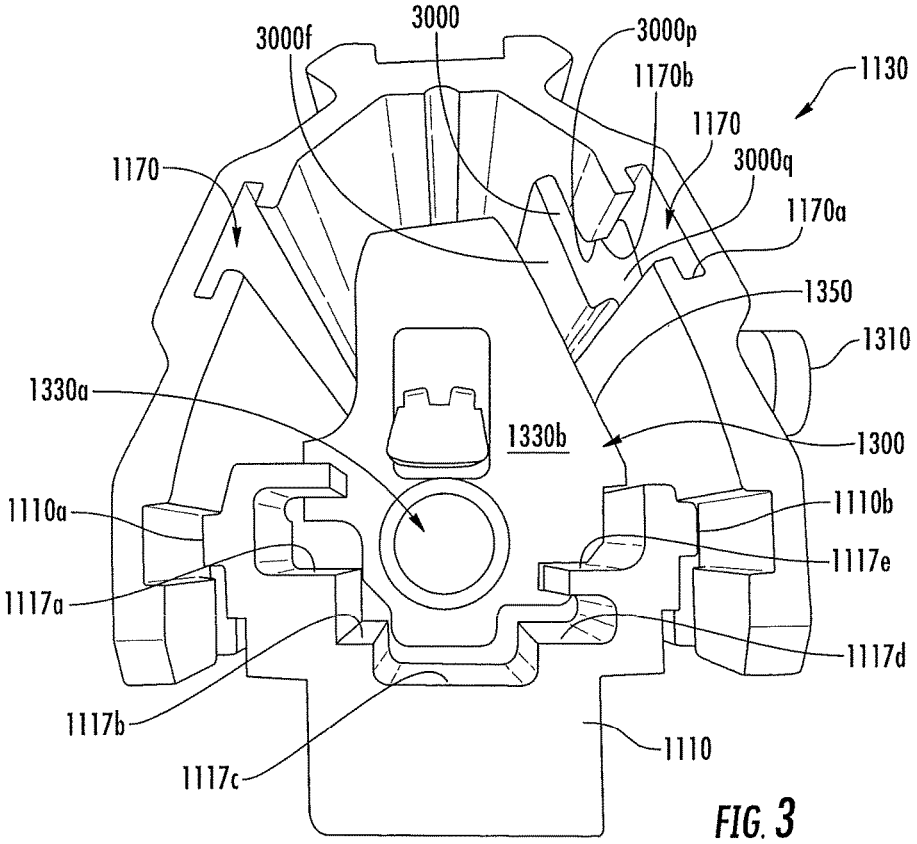
Figure 4A:
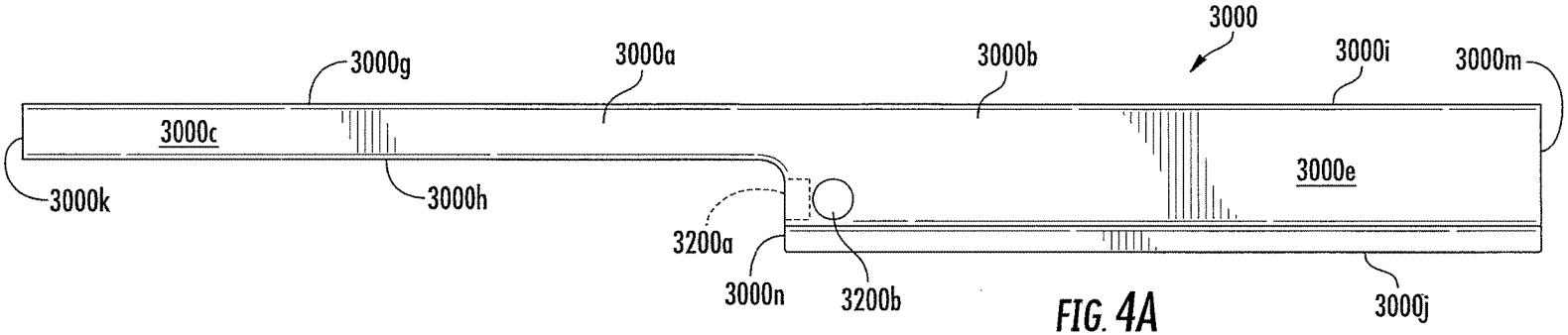
Figure 4B:
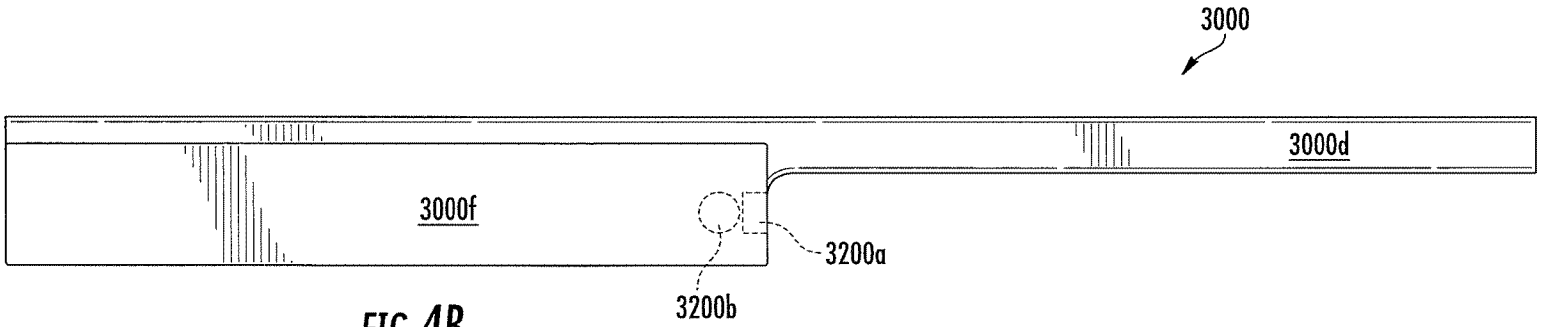
Figure 4C:
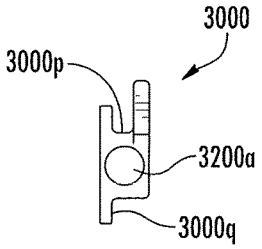
Figure 4D:
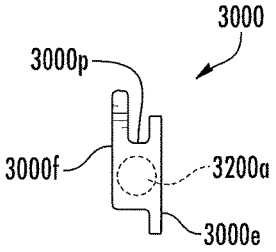
Figure 4E:
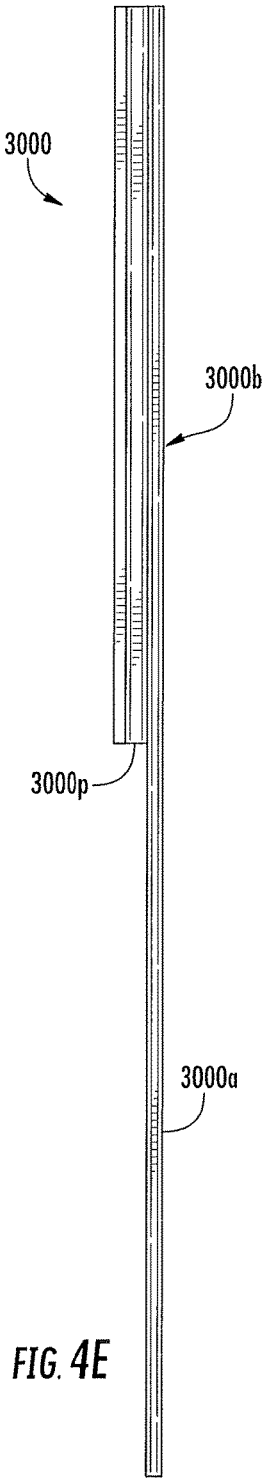
Figure 4F:
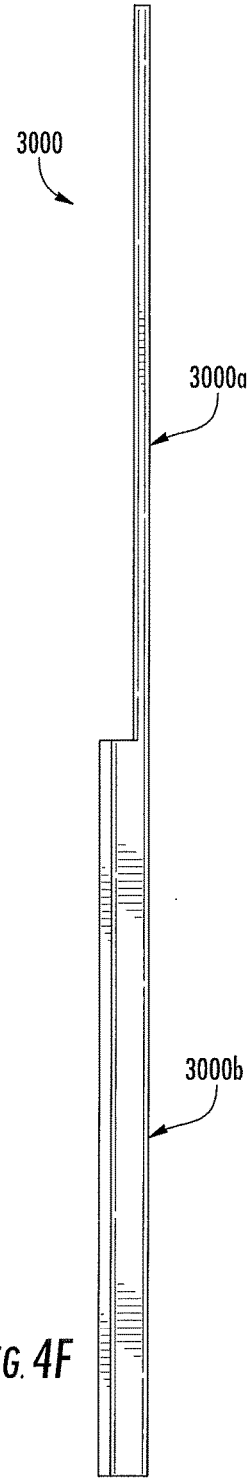

Having thus described exemplary aspects of the disclosure in general terms, various objects, features, and attendant advantages of the disclosed concepts will become more fully appreciated as the same becomes better understood when considered in conjunction with the accompanying drawings, which are not necessarily drawn to scale, in which like reference characters designate the same or similar parts throughout the several views, and wherein:

FIG. 1 is a perspective view of one implementation of a firearm system described herein;

FIG. 2A is a schematic view of one implementation of a firearm system described herein illustrating one implementation of a cover comprising a body member described herein illustrating a bolt carrier of the firearm system is in the forward position;

FIG. 2B is a schematic view of one implementation of a firearm system described herein illustrating one implementation of a cover comprising a body member described herein illustrating a bolt carrier of the firearm system is in a position between the forward position and a rearward position;

FIG. 2C is a schematic view of one implementation of a firearm system described herein illustrating one implementation of a cover comprising a body member described herein illustrating a bolt carrier of the firearm system is in the rearward position;

FIG. 3 is a schematic view of one implementation of a top rail cover, a lower receiver, and a cover comprising a body member described herein;

FIG. 4A is a left side elevational view of one embodiment of a cover comprising a body member described herein;

FIG. 4B is a right-side elevational view of one embodiment of a cover comprising a body member described herein;

FIG. 4C is a front-end elevational view of one embodiment of a cover comprising a body member described herein;

FIG. 4D is a rear-end elevational view of one embodiment of a cover comprising a body member described herein;

FIG. 4E is a top plan view of one embodiment of a cover comprising a body member described herein; and FIG. 4F is a bottom plan view of one embodiment of a cover comprising a body member described herein.

DETAILED DESCRIPTION

Examples of the present disclosure will now be described more fully hereinafter with reference to the accompanying drawings, in which some, but not all examples of the disclosure are shown. Indeed, various exemplary aspects of the disclosure may be embodied in many different forms and should not be construed as limited to the examples set forth herein. Rather, these examples are provided so that this disclosure will be thorough and complete and will fully convey the scope of the disclosure to those skilled in the art. Like reference numerals refer to like elements throughout.

As used herein, "and/or" means any one or more of the items in the list joined by "and/or." Further, as used herein, the term "exemplary" means serving as a non-limiting example, instance, or illustration. Moreover, as used herein, the term, for example, or "e.g.," introduces a list of one or more non-limiting examples, instances, or illustrations.

As used herein, "magnetic material" includes material to which a magnet or magnetic forces are attracted, including without limitation, ferromagnetic materials and ferromagnetic materials, and "firearm" or "firearm system" includes rifles, pistols, shotguns, and other barreled weapons that launch one or more projectiles, including without limitation, devises that use gunpowder, black powder, other explosive force, air pressure, spring pressure and/or fluid pressure to launch a projectile.

Referring now to the figures, there is illustrated a firearm system, generally designated as reference number 1000, in accordance with one embodiment described herein. FIG. 1 illustrates a fully assembled firearm system, generally (1000), which can generally comprise or include, for example, a receiver assembly, generally (1100), gas assembly, generally (1200), bolt assembly, generally (1300), stock, generally (1400), magazine, generally (1500), grip, generally (1600), trigger assembly, generally (1700), barrel, generally (1800), muzzle brake, generally (1900), and/or an ambidextrous safety assembly (2000) which can be operated from either a left or right side of the firearm system (1000) to select between a firing position and a safe position. The firearm system (1000) can comprise any combination of the foregoing elements or components not inconsistent with the objectives of the present invention.

Turning now to specific components and FIGS. 1, 2A, 2B, and 2C, receiver assembly (1100) can comprise, consist, or consist essentially of an upper receiver (1110), lower receiver (1120), top rail cover (1130), takedown latch (1140), and/or rear trunion (1150). Receiver assembly (1100) can comprise a lower receiver (1120) as illustrated in FIGS. 1, 2A, 2B, and 2C.

As shown in FIG. 3, the upper receiver (1110) can have one or more, integrated tracks (1110*a*, 1110*b*) in order to permit the upper receiver (1110) to be slidably coupled with additional components of the firearm system (1000), such as top rail, or upper receiver, cover, generally (1130). The upper receiver (1110) can also include a plurality of interior tracks (1117*a*, 1117*b*, 1117*c*, 1117*d*, and 1117*e*) configured to receive components such as a bolt assembly (1300).

Receiver assembly (1100) can be adapted or configured to receive a safety assembly (2000), which could be ambidextrous (and of a structure and configuration as disclosed in my co-pending U.S. patent application Ser. No. 14/815,291, filed Jul. 31, 2015, the entirety of which is incorporated by reference), which can be operated from either a left or right side of the firearm system (1000) to select between a firing position and a safe position. The safety assembly (2000) can be connected to or in mechanical combination with a trigger assembly (1700).

Firearm systems (1000) can further comprise a bolt assembly (1300) as illustrated in FIGS. 1, 2A, 2B, 2C, and 3. A bolt assembly (1300) can comprise a charging handle (1310) and a bolt carrier (1330) that carries a bolt (not shown). Bolt carrier 1330 includes a bore (1330*a*) (FIG. 3) for receiving a cartridge (not shown).

In some implementations, the charging handle (1310) is ambidextrous, and can be inserted from either a left or right side of the firearm system (1000), and if moved to the left side of the firearm 1000, the components herein could be configured to permit the dust cover 3000 as described herein to operate on the left side in like manner as on the right side. As previously discussed, the design can be, in some implementations, ambidextrous such that the charging handle (1310) can be inserted from either the left or right of the upper receiver (1110). When actuated with propellant gas resulting from the firing of a round (not shown), a piston (not shown) pushes the bolt carrier (1330) backwards as gas is released into the gas assembly (1200), and a recoil spring (not shown) returns the piston (1240) and the attached bolt carrier (1330) to the forward position to complete the firing/loading cycle.

The foregoing bolt assembly or system design permits ejection of a spent case of a round of ammunition with a spring-loaded plunger located in the bolt face, which ejects the case through an ejection port (1160) as soon as the case mouth clears the chamber on extraction. Such a design can permit successful ejection even in the event of an incomplete cycle without necessity to clear the spent case from the action of the firearm system.

As noted above, in one implementation, a dust cover, or cover (2900)(FIG. 1), comprising a body member, (3000) is described for use in firearm (1000), and the firearm is operable for firing a cartridge (not shown) having a projectile and having a receiver portion (1100) including an elongated passageway (3100) and an ejection port (1160) adapted to allow the cartridge to be expended therethrough upon firing of the cartridge. A magnetic reciprocatable firing mechanism, which could include bolt assembly (1300) (which may comprise a bolt carrier (1330) with a bolt (not shown)) is operable to fire the cartridge, and barrel (1800) is adapted to receive the projectile after the cartridge is fired.

The body member (3000) is adapted to selectively substantially cover the passageway (3100). At least one magnet 3200 is connected to the body member and is magnetically attracted to the firing mechanism such that the body member is drawn towards and substantially follows the firing mechanism as the firing mechanism reciprocates with respect to the receiver upon firing the cartridge, wherein the body member intermittently uncovers the passageway (3100) as the firing mechanism reciprocates. Dust cover (3000) could be added to a firearm (1000) as an after-market item, or dust cover (3000) could be provided/manufactured in the firearm by an original equipment manufacturer (OEM) of firearms.

In use, body member 3000, bolt carrier (1300) and charging handle (1310) (which is attached to bolt carrier 1300) are in a forward most position, as shown in FIG. 2A. In this configuration, portion (3100*a*) of passageway (3100) is covered. Gap (3100*a*) is the distance between the extreme rear end (1330*b*) (FIG. 3) of the bolt carrier and the leftmost end (3100*b*) of passageway (3100) (as shown in FIG. 2A). The charging handle is mounted on the forward portion of the bolt carrier to facilitate use of the firearm by a user. The distance the extreme rear end (1330*b*) travels as it moves to the rearward most position (FIG. 2C) is further than the distance between the extreme rear end (1330*b*) of the charging handle (1310). Accordingly, in an example implementation, a gap (3100*a*) exists in the passageway (3100) of a length that approximately corresponds to the distance between the extreme rear end (1330*b*) and the charging handle (1310). Upon a round of ammunition, i.e., a cartridge with a projectile, being chambered in upper receiver (1110) and firing of the round, bolt carrier (1300*a*) and charging handle (1310) move rectilinearly rearwardly with respect to the receiver assembly (1100), Specifically, bolt carrier (1300) moves within upper receiver (1110), and charging handle (1310) moves through passageway (3100). Body member (3000) moves with bolt carrier (1300) and charging handle (1310) via physical contact therewith and/or the magnetic attraction of the cover (2900) (FIG. 1) to the bolt carrier and/or the handle (1310) via one or more magnets (3200), which may specifically include magnets (3200*a* and 3200*b*), as shown in FIGS. 4A-4F.

After firing, the bolt carrier, the charging handle and the body member (3000) continue to move rearwardly. FIG. 2B shows the bolt carrier, the charging handle and the body member (3000) in an intermediate position between the forward most position (FIG. 2A) and a rearward position (FIG. 2C).

FIG. 2C shows the bolt carrier, the charging handle and the body member (3000) in the rearward most position, as compared to FIGS. 2A and 2B, and this is substantially the configuration of such components would be in when the spent cartridge (not shown) would be ejected through the ejection port (1160). Once the rearward most position is reached, the bolt carrier, the charging handle and the body member (3000) reciprocate forward, back towards the forward most position as shown in FIG. 2A. In this forward most position, the gap (3100*a*) is covered by body member (3000). Note that in FIG. 2C, charging handle has moved into gap (3100*a*) and is permitted to do so, because the body member (3000) has moved rearwardly within upper receiver due to the magnetic attraction and/or physical contact with the bolt carrier and/or the charging handle.

Upon the bolt carrier and charging handle moving back towards the forward most position, one of the magnets (3200) are attracted to the bolt carrier and/or the charging handle with a magnetic force sufficient to pull the body member (3000) with the bolt carrier and/or the charging handle back to the starting position of the body member (3000), as shown in FIG. 2A. Given that most of the time the firearm is likely not in use, the gap (3100*a*) will remain covered by body member (3000) during, e.g., during storage and transport, and will typically not otherwise be displaced from such covering position except when the firearm is in use, wherein gap 3100*a* is then uncovered intermittently through movement of bolt carrier 1300.

In one implementation, the body member (3000) moves, or reciprocates, within a slot, passageway, or track, (1170) which could be T-shaped track in top rail, or receiver, cover (1130). The body member travels to and fro in track (1170) as the body member reciprocates with the bolt carrier and the charging handle as the firearm is fired and/or as a round is manually chambered. The body member is guided by track (1170) into position in the forward most position (FIG. 2A) and rearward most (FIG. 2C) position.

Once inserted into the track (1170), a first, front-mounted magnet (3200*a*) holds the dust cover in position against gravity or other forces in the forward most position. A second, side-facing magnet (3200*b*) is attracted to the magnetic material of the bolt carrier.

In certain implementations the dust cover (2900) comprises body member (3000) being elongated and generally rectangular in shape and includes a forward portion (3000*a*) and a rearward portion (3000*b*), with the forward portion (which in one implementation is substantially uniform thickness and height along its length) having a first side (3000*c*) and a second side (3000*d*) generally opposite the first side (3000*c*). The rearward portion (3000*b*) includes a first side (3000*e*) and a second side (3000*f*) generally opposite the first side (3000*e*). The first side (3000*c*) of the forward portion (3000*a*) is adjacent the first side (3000*e*) of the rearward portion, and the second side (3000*d*) of the forward portion (3000*s*) is adjacent the second side (3000*f*) of the rearward portion (3000*d*). The forward portion (3000*a*) includes a top edge (3000*g*) and a bottom edge (3000*h*) generally opposite the top edge. The rearward portion includes a top edge (3000*i*) and a lower edge (3000*j*), and the top edge (3000*g*) of the forward portion is adjacent the top edge (3000*i*) of the rearward portion. The forward portion (3000*a*) includes a forward extreme end (3000*k*) and the rearward portion having an extreme rear end (3000*m*) substantially opposite the forward extreme end. The rearward portion also defines a leading face (3000*n*) substantially opposite the extreme rear end. In one implementation, magnet (3200*a*) is in the leading face (3000*n*), and magnet (3200*b*) is in the first face of the rearward portion (3000*b*).

In certain example implementations, the first side (3000*c*) of the forward portion (3000*a*) of the dust cover and the first side (3000*e*) of the rearward portion are substantially coplanar, and the top side of the forward portion (3000*a*) and top side the rearward portion (3000*b*) are substantially co-planar. Additionally, the forward portion is of less height than the rearward portion, resulting in the bottom side of the forward portion being noncontiguous, or separated, from the bottom side of the rearward portion. Upon insertion into the track (1170), the second side of the rearward portion of the body member (3000) is adjacent top rail cover (1130). The rearward portion includes a longitudinally extending groove (3000*p*) and a rail (3000*q*). The rail (3000*q*) is received in a lower channel (1170*a*), and flange (1170*b*) is received by groove (3000*p*) track (1170) as body member (3000) moves to and fro.

Unless otherwise noted herein, other construction and/or operation details of one or more implementations of firearm system (1000) may be generally similar to that of standard AK-47 rifles, which are known to those of skilled in the art, and, accordingly, such details are not set forth herein in the interest of brevity and conciseness.

In the following description, numerous specific details are set forth in order to provide an understanding of the present invention. It will be apparent, however, to one skilled in the art that the present invention may be practiced without these specific details. Thus, the specific details set forth are merely exemplary. The specific details may be varied from and still be contemplated to be within the scope of the present invention. Although specific terms are employed herein, they are used in a generic and descriptive sense only and not for purposes of limitation.

While the disclosed concepts have been described in connection with what is considered the most practical and preferred implementation, it is to be understood that the disclosed concepts are not to be limited to the disclosed arrangements, but are intended to cover various arrangements which are included within the scope of the broadest possible interpretation of the appended claims so as to encompass all modifications and equivalent arrangements which are possible.

Therefore, it should be understood that the various examples of the apparatus(es) disclosed herein may include any of the components, features, and functionalities of any of the other examples of the apparatus(es) disclosed herein in any feasible combination, and all of such possibilities are intended to be within the scope of the present disclosure. Many modifications of examples set forth herein will come to mind to one skilled in the art to which the present disclosure pertains having the benefit of the teachings presented in the foregoing descriptions and the associated drawings.

The invention claimed is:

1. An apparatus for use in a firearm, the firearm being operable for firing a cartridge having a projectile and having a receiver portion including an elongated passageway having a first portion, a firing mechanism having a magnetic portion and operable to fire the cartridge and being adapted for rearward movement with respect to the receiver portion upon the firing of the cartridge and subsequent forward movement, a charging handle connected to the firing mechanism and adapted to move in the passageway, and a barrel adapted to receive the projectile after the cartridge is fired, the apparatus comprising:

a cover adapted for movement and to substantially cover the first portion of the passageway;

at least one magnet connected to the cover and adapted to be magnetically attracted to the magnetic portion of the firing mechanism such that the cover is drawn towards and substantially follows the firing mechanism during forward movement;

wherein the cover is adapted to move to and fro as the firing mechanism moves with respect to the receiver portion; and wherein the cover is adapted to intermittently substantially cover and uncover the first portion of the passageway as the firing mechanism moves.

2. The apparatus of claim 1, further comprising:

at least one magnet being adapted to be magnetically attracted to the magnetic portion of the firing mechanism such that the cover is drawn towards and substantially follows the firing mechanism during rearward movement of the firing mechanism.

3. The apparatus of claim 1, wherein:

the firing mechanism is elongated and has a forward end and a rearward end;

the firing mechanism is movable between a forward position substantially adjacent the barrel and a rearward position;

the passageway has forward end and a rearward end; and the first portion of the passageway is approximately the distance between the rearward end of the passageway and the rearward end of firing mechanism upon the firing mechanism being in the forward position.

4. The apparatus of claim 1, further comprising:

the receiver portion defining at least one interior track; and wherein the cover is adapted to move to and fro within the interior track as the firing mechanism moves with respect to the receiver portion upon firing the cartridge.

5. The apparatus of claim 1, wherein the firing mechanism includes a bolt carrier.

6. The apparatus of claim 1, wherein:

the cover includes a body member that is elongated and includes a forward portion and a rearward portion;

the forward portion includes a first side and a second side;

the rearward portion includes a first side and a second side;

the first side of the forward portion is adjacent the first side of the rearward portion, and the second side of the forward portion is adjacent the second side of the rearward portion;

the forward portion includes a top edge and a bottom edge;

the rearward portion includes a top edge and a bottom edge;

the top edge of the forward portion is adjacent the top edge of the rearward portion;

the forward portion includes a forward extreme end and the rearward portion having an extreme rear end substantially opposite the forward extreme end; and the rearward portion defines a leading face substantially distal from the extreme rear end.

7. The apparatus of claim 6, wherein:

the first side of the forward portion and the first side of the rearward portion are substantially co-planar.

8. The apparatus of claim 6, wherein:

the top side of the forward portion and top side the rearward portion are substantially co-planar.

9. The apparatus of claim 6, wherein:

the forward portion is substantially rectangular.

10. The apparatus of claim 6, wherein:

the rearward portion is substantially rectangular.

11. The apparatus of claim 6, wherein:

the forward portion is substantially rectangular;

the rearward portion is substantially rectangular; and the forward portion is integral with the rearward portion.

12. The apparatus of claim 6, wherein:
the at least one magnet is connected to the rearward portion.

13. The apparatus of claim 6, wherein:
the at least one magnet is connected to the leading face of the rearward portion.

14. The apparatus of claim 6, wherein:
the at least one magnet is connected to the second side of the rearward portion.

15. The apparatus of claim 1, wherein:
the at least one magnet includes a first magnet and a second magnet.

16. The apparatus of claim 1, further comprising:
the receiver portion defining at least one interior track;
the cover being adapted to move to and fro within the interior track as the firing mechanism moves with respect to the receiver portion upon firing the cartridge;
the cover being elongated and including a forward portion and a rearward portion;
the rearward portion including a first side and a second side; and
the second side of the rearward portion of the cover is carried in the interior track of the receiver portion.

17. The apparatus of claim 1, further comprising:
the cover being elongated and including a forward portion and a rearward portion;
the forward portion including a first side and a second side; and
the rearward portion including a first side and a second side.

18. The apparatus of claim 1, wherein:
the cover includes a body portion that is elongated and includes a forward portion and a rearward portion, the rearward portion including a leading face;
the at least one magnet includes a first magnet connected to the leading face of the rearward portion and a second magnet connected to the rearward portion.

19. The apparatus of claim 1, wherein:
the cover includes a body portion that is elongated and includes a forward portion and a rearward portion; and
the rearward portion includes a longitudinally extending groove adapted to slidingly engage the interior track of the receiver portion.

20. The apparatus of claim 1, further comprising:
the cover having a forward portion and a rearward portion; and
a rail extending along the bottom edge of the rearward portion.

21. The apparatus of claim 1, wherein:
the cover is constructed of a non-metallic material.

22. The apparatus of claim 1, wherein the cover is adapted for rectilinear movement.

23. The apparatus of claim 15, wherein the cover is adapted to automatically substantially cover the first portion of the passageway prior to and after the cartridge is fired.

24. An apparatus for use in a firearm, the firearm being operable for firing a cartridge having a projectile and having a receiver portion including an elongated passageway having a first portion, a firing mechanism having a magnetic portion and operable to fire the cartridge and being adapted for rearward movement with respect to the receiver portion upon the firing of the cartridge and subsequent forward movement, a charging handle connected to the firing mechanism and adapted to move in the passageway, and a barrel adapted to receive the projectile after the cartridge is fired, the apparatus comprising:
the receiver portion defining at least one interior track;
a cover adapted for movement and to substantially cover the first portion of the passageway;
at least one magnet connected to the cover and adapted to be magnetically attracted to the magnetic portion of the firing mechanism such that the cover is drawn towards and substantially follows the firing mechanism during forward movement;
wherein the cover is adapted to move to and fro within the interior track as the firing mechanism moves with respect to the receiver portion; and
wherein the cover is adapted to intermittently substantially cover and uncover the first portion of the passageway as the firing mechanism moves.

25. The firearm of claim 24, wherein:
the firing mechanism is elongated and has a forward end and a rearward end;
the firing mechanism is movable between a forward position substantially adjacent the barrel and a rearward position;
the passageway has forward end and a rearward end; and
the first portion of the passageway is approximately the distance between the rearward end of the passageway and the rearward end of firing mechanism upon the firing mechanism being in the forward position.

26. The apparatus of claim 24, wherein the cover is adapted to automatically substantially cover the first portion of the passageway prior to and after the cartridge is fired.

27. The apparatus of claim 24, wherein the cover is adapted to substantially cover the first portion of the passageway prior to and after the cartridge is fired.

28. A firearm for firing a cartridge having a projectile, the firearm comprising:
a receiver portion adapted to receive the cartridge:
the receiver portion including an elongated passageway having a first portion;
a firing mechanism having a magnetic portion and a firing device operable to fire the cartridge;
a charging handle connected to the firing mechanism and adapted to move in the passageway;
a barrel adapted to receive the projectile after the cartridge is fired;
the firing mechanism being adapted for rearward movement with respect to the receiver portion upon the firing of the cartridge and subsequent forward movement;
a cover adapted for movement and to selectively cover a portion of the passageway;
at least one magnet connected to the cover and adapted to be magnetically attracted to the magnetic portion of the firing mechanism such that the cover is drawn towards and substantially follows the firing mechanism during forward movement of the firing mechanism; and
wherein the cover is adapted to intermittently substantially cover and uncover the first portion of the passageway as the firing mechanism moves.

29. The firearm of claim 28, wherein:
the firing mechanism is elongated and has a forward end and a rearward end;
the firing mechanism is movable between a forward position substantially adjacent the barrel and a rearward position;
the passageway has forward end and a rearward end; and
the first portion of the passageway is approximately the distance between the rearward end of the passageway and the rearward end of firing mechanism upon the firing mechanism being in the forward position.

30. The apparatus of claim 28, wherein the cover is adapted to automatically substantially cover the first portion of the passageway prior to and after the cartridge is fired.

* * * * *